United States Patent [19]

Minami et al.

[11] Patent Number: 4,704,770

[45] Date of Patent: Nov. 10, 1987

[54] PULL TAB FOR SLIDE FASTENER

[75] Inventors: Hiroo Minami; Sadaho Asahi, both of Uozu, Japan

[73] Assignee: Yoshida Kogyo K.K., Tokyo, Japan

[21] Appl. No.: 927,127

[22] Filed: Nov. 5, 1986

[30] Foreign Application Priority Data

Nov. 15, 1985 [JP] Japan ..... 60-176299[U]

[51] Int. Cl.[4] ..... A44B 19/26; G09F 3/18

[52] U.S. Cl. ..... 24/431; 40/21 C

[58] Field of Search ..... 24/431, 432, 437, 163 K, 24/49 K, 3 F; 40/21 C

[56] References Cited

U.S. PATENT DOCUMENTS

| | | | |
|---|---|---|---|
| 1,400,666 | 12/1921 | Douglas | 40/21 C |
| 2,145,118 | 1/1939 | Knoess | 24/431 |
| 2,221,759 | 11/1940 | Erard | 24/431 |
| 2,985,006 | 5/1961 | DuBois | 24/3 F |
| 3,421,341 | 1/1969 | Hodge | 40/21 C |
| 3,434,414 | 3/1969 | Wright | 24/49 K |
| 3,583,044 | 6/1971 | Howell | 24/431 |
| 3,969,836 | 7/1976 | DuBois | 40/21 C |
| 4,031,859 | 6/1977 | Stewart | 40/21 C |
| 4,177,587 | 12/1979 | Dorsen et al. | 40/21 C |
| 4,408,406 | 10/1983 | Barton | 40/21 C |

*Primary Examiner*—Victor N. Sakran

*Attorney, Agent, or Firm*—Hill, Van Santen, Steadman & Simpson

[57] ABSTRACT

A pull tab for a slide fastener slider comprises a body of a transparent, resilient material having a chamber, a display card releasably inserted in the chamber to be viewed from both sides, and an end cap means for closing the chamber. The pull tab body is generally rectangular in shape, and the display card is substantially coextensive therewith so that information on the card in the form of marks or words can be fully viewed.

12 Claims, 16 Drawing Figures

PULL TAB FOR SLIDE FASTENER

BACKGROUND OF THE INVENTION

1. Field of the Invention

This invention relates to improvements in and relating to sliders for slide fasteners and more particularly to pull tabs for such sliders.

2. Prior Art

There are known slide fasteners equipped with sliders having pull tabs with which to move the slider to open or close the fastener. In addition to this conventional function, advanced pull tabs are designed to carry thereon indicia or marks showing the origin or tradename of the fastener product, or other information identifying the user by name and address.

One prior art device is disclosed in Japanese Utility Model Laid-Open Publication No. 57-20219 which is concerned with a slider pull tab having connected thereto a framed seal receptacle to which a sealing strip is adhered. With this type of pull tab accessory, it is difficult to do handwriting on a limited space of the strip, or to show on one side thereof all the information desired.

Another prior art device is taught in Japanese Utility Model Publication No. 58-185910 which discloses a slider pull tab having connected thereto a locket with an openable cover. This device has a similar drawback in that the locket is available for printing or writing only on one side, and furthermore the difficulty is that the locket is liable to be damaged when it is grabbed hard together with the pull tab to move the slider under the influence of severe lateral pull or force applied to the fastener.

SUMMARY OF THE INVENTION

It is therefore the primary object of the present invention to provide pull tabs for slide fastener sliders which can be utilized for display of information or indicia fully on both sides of the tab and manipulated easily without undue stress.

This and other objects and features will be apparent from the following detailed description taken in connection with the accompanying drawings in which like reference numerals refer to like and corresponding parts.

DETAILED DESCRIPTION

Figure 1:
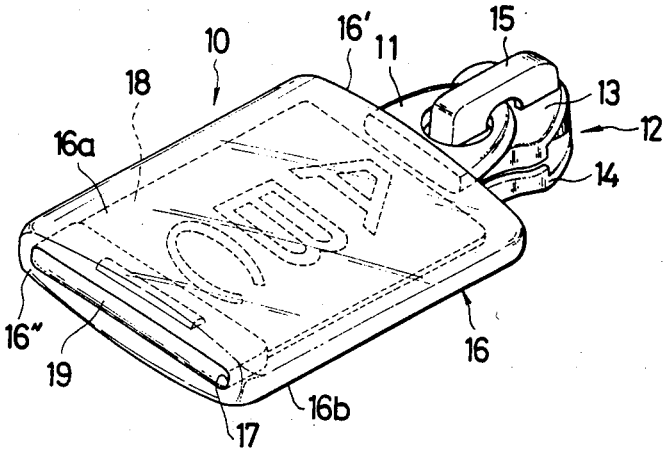
FIG. 1 is a perspective view of a pull tab according to one embodiment of the invention.
Figure 2:
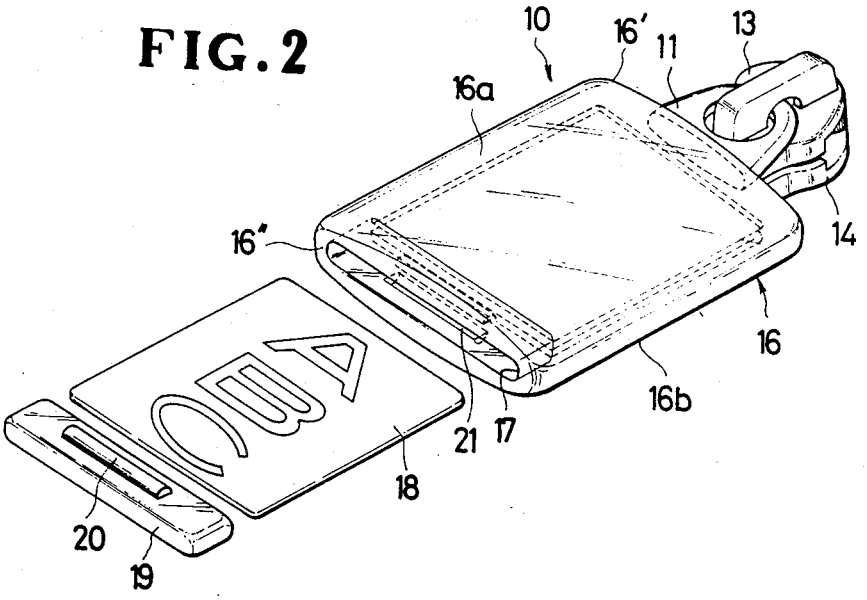
FIG. 2 is a perspective, partly exploded view of the pull tab of FIG. 1.
Figure 3:
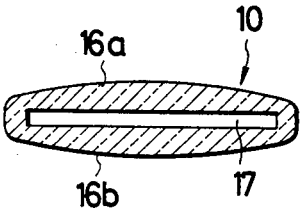
FIG. 3 is a cross-sectional end view of the pull tab of FIG. 1.
Figure 4:
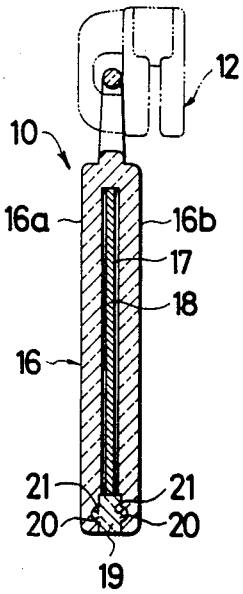
FIG. 4 is a longitudinal cross-sectional view of the pull tab of FIG. 1.

Referring to the drawings and FIG. 1 in particular, there is shown a slider pull tab 10 pivotally connected at one of its ends via link 11 to a slider 12 for a slide fastener not shown. The slider 12 may be of any conventional design and construction, and it includes, as illustrated, an upper wing 13 and a lower wing 14 connected thereto at one end and a trunnion 15 to which the pull tab 10 is pivotally connected.

The pull tab 10 according to one embodiment of the invention shown in FIGS. 1–4 comprises a generally rectangular body 16 made of a transparent resilient material including an upper wall **16*a* and a lower wall 16*b* defining therebetween a chamber 17 substantially coextensive with the body 16. The pull tab body 16 has one end 16' closed with which the link 11 is attached or integrally formed and the other end 16" open to communicate the chamber 17** with the atmosphere.

Designated at 18 is a rectangular display card of paperboard or plastic material carrying thereon indicia or identification marks or words such as names, addresses telephone numbers, etc. The display card 18 is inserted through the open end 16" fully into the chamber 17. Advantageously, the upper and lower walls **16*a*, 16*b* of the pull tab body 16 are made transparent to permit the display card 18, when inserted, to be viewed from both sides, so that sufficient display information may be carried on the card 18**.

The upper and lower walls **16*a*, 16*b*** have lens-like convex outer surfaces.

Designated at 19 is an end cap for closing the open end 16" of the pull tab body 16, for which purpose it is provided on each side with a ridge 20 engageable in a complementary groove 21 formed in each of the upper and lower walls **16*a* and 16*b*. Since the pull tab body 16 is made of a resilient material, the, end cap 19 can be snap-fitted with the pull tab 10 as the ridges 20 slip into the grooves 21**.

Figure 5:
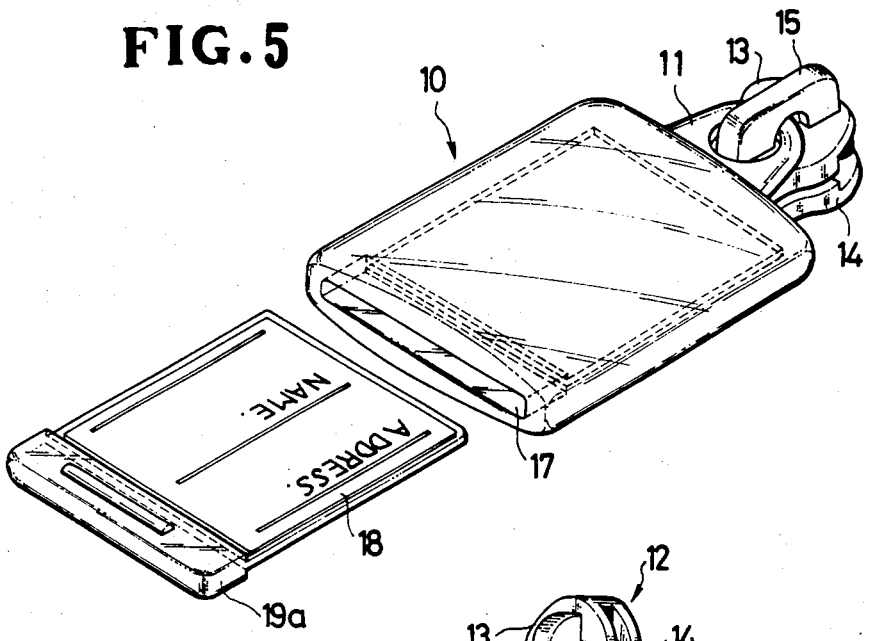
FIG. 5 is a perspective, partly exploded view of a pull tab according to another embodiment of the invention.

The embodiment shown in FIG. 5 is the same as that of FIGS. 1–4, except that the end cap 19 is formed integral with the display card 18.

Figure 6:
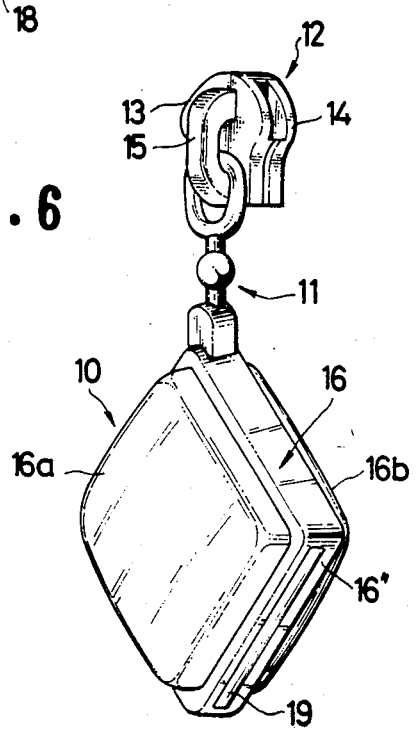
FIG. 6 is a perspective view of a pull tab according to a further embodiment of the invention.

FIG. 6 shows a modification of the pull tab 10 of FIG. 1–4 in which the pull tab body 16 is substantially square and has a link 11 in the form of a ball chain extending from one of the corners of the body 16. Conveniently, the open end 16" for receiving the display card 18 may be provided at any one of the four sides of the square body 16.

Figure 7:
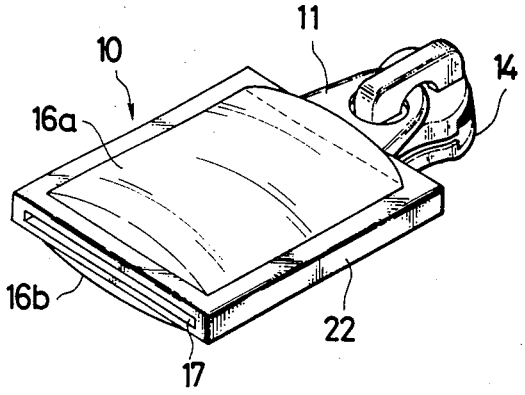
FIG. 7 is a perspective view of still another embodiment of the invention.
Figure 8:
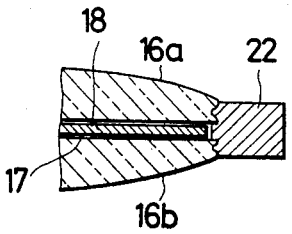
FIG. 8 is a transverse cross-sectional view of a portion of the pull tab of FIG. 7.

FIGS. 7 and 8 show another modification which is similar to but differing from the pull tab 10 in that the marginal sides of the upper and lower walls **16*a* and 16*b* are encased in and supported by a frame member 22** of a metal such as aluminum.

Figure 9:
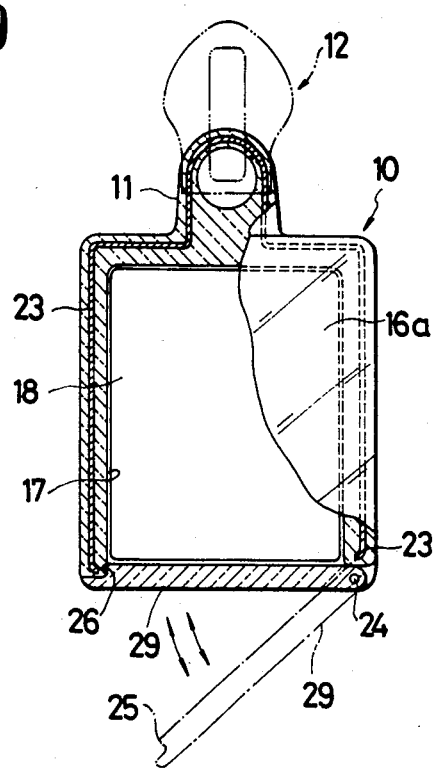
FIG. 9 is a partly broken away plan view of a pull tab according to a still further embodiment of the invention.

The modification shown in FIG. 9 is similar to the pull tab 10 of FIG. 7 but differs in that there is additionally provided a reinforcing wire 23 which is embedded in and extends peripherally around the pull tab body 16 and further in that the end cap is in the form of a pivotal bar 29 which is hinged at one end with a pin 24, with the other end hooked as at 25 to releasably engage a complementary recess 26.

Figure 10:
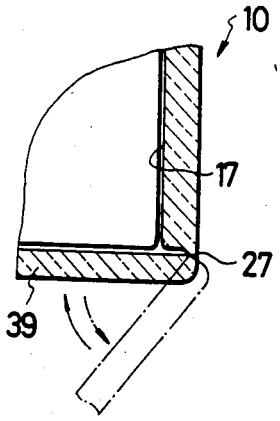
FIG. 10 is a partial cross-sectional view showing a hinged end of the end cap.

FIG. 10 shows a modification of the end cap 29 of FIG. 9 in that the end cap 29 is connected by a flexible connector strip 27 interconnecting integrally between the one end of the end cap and the pull tab 10.

FIGS. 11 through 16 show other modified end caps.

Figure 11:
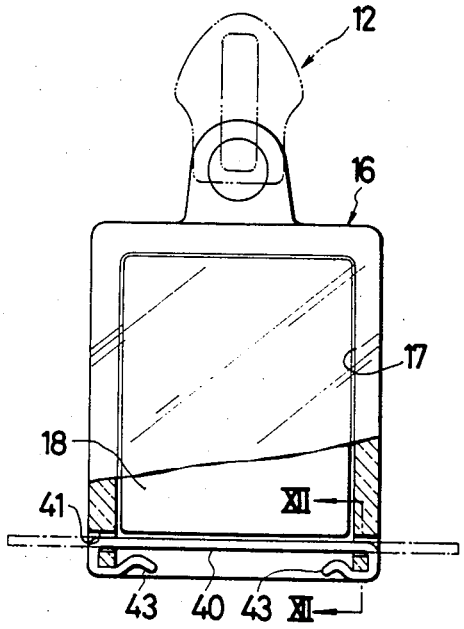
FIG. 11 is a partially broken away plan view of a pull tab according to a further embodiment of the invention.
Figure 12:
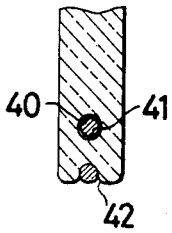
FIG. 12 is an enlarged cross-sectional view taken along line XII—XII of FIG. 11.

FIGS. 11 and 12 show an end cap 40 made of a steel rod or wire extending through a pair of through-holes 41, 41 disposed respectively at two lateral end portions of the rectangular body 16 adjacent to the open end of the chamber 17. The end cap 40 extends transversely through the end opening of the chamber 17 and has opposite ends 43 bent along a pair of grooves 42 disposed at end surfaces of the rectangular body 16. The opposite ends 43 are curved into the opening of the chamber 17.

For detaching the end cap 40, one of the curved ends 43 is stretched out as shown in a phantom line and then the cap 40 is pulled out in an axial direction of the other one of the curved ends.

Figure 13:
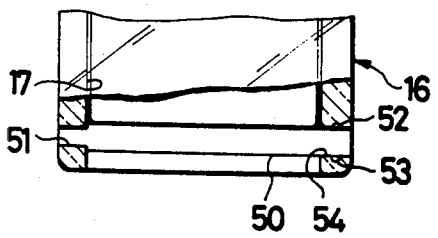
FIGS. 13 and 14 are partially broken away plan views of a pull tab according to a further embodiment of the invention.

In FIG. 13, an end cap 50 is in the form of a bar 50 having a rectangular for circular cross section. The bar 50 has one distal end of a stepwisely reduced section area, a pair of diametrically opposite projections 52 being disposed at the other end of the bar 50. A through-hole 51 is disposed at one of two lateral end portions of the rectangular body 16, and another through-hole 54 is disposed at the other one of the two lateral portions as shown in FIG. 13. A pair of diametrically opposite recesses 53 are disposed in an inner wall of the through-hole 54. The bar 50 is inserted through the through-holes 54, 51 successively so that the reduced end is fitted into the through-hole 51 and the projections 52 are snap-fitted into the recesses 53.

Figure 14:
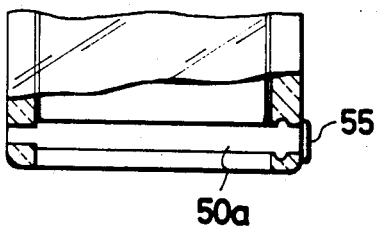

FIG. 14 shows a bar **50*a* similar to the bar 50 of FIG. 13 except in that the bar 50*a* includes a head collar 55 disposed at one end of the bar remote from the reduced end. When the bar 50 is to be removed from the rectangular body, an axial force is applied to the reduced end of the bar 50**.

Figure 15:
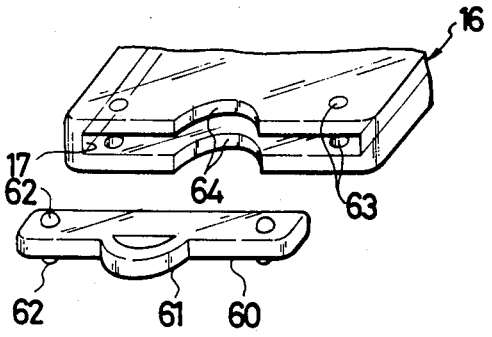
FIGS. 15 and 16 are perspective partial views of a pull tab according to a further embodiment of the invention.

In FIG. 15, an end cap 60 has a grip 61 disposed at an outer side of the end cap body such that the grip 61 extends out of the chamber 17 when the end cap is fully inserted into the chamber 17. A pair of bay portions 64 are disposed at the open end of the rectangular body 16 so as to allow a further end cap portion to extend out of the chamber. The bay portions make it easier for a user's fingers to grasp the grip 61. The end cap 60 has two pairs of projections 62 at opposite sides thereof near the respective ends of the cap 60. The rectangular body has two pairs of recesses 63 disposed in inner walls of the upper and lower wings thereof and corresponding in position to the projections 62 such that the projections snap-fit into the recesses 63 when the end cap is inserted into the chamber 17.

Figure 16:
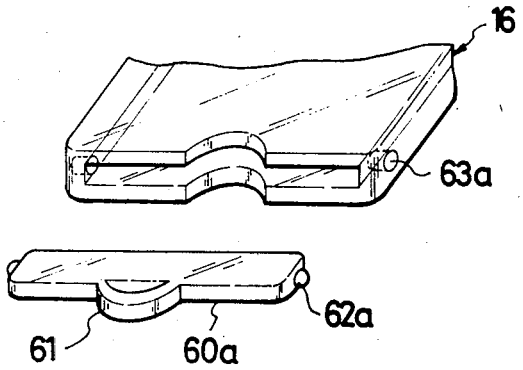

FIG. 16 shows a modified end cap **60*a* similar to the end cap 60 of FIG. 15. The end cap 60*a* has a pair of snap fit projections 62*a* at opposite ends, which are adapted to be snap-fitted into a pair of recesses 63*a* disposed in inner side walls of the rectangular body 16**.

Although various minor modifications may be suggested by those versed in the art, it should be understood that we wish to embody within the scope of the patent warranted hereon, all such embodiments as resonably and properly come within the scope of our contribution to the art.

What is claimed is:

1. A slider pull tab having a link at one end thereof for connecting the same to a slider body, said pull tab comprising a pull tab body of a transparent resilient material including an upper wall and a lower wall integrally joined together and defining therebetween a chamber substantially coextensive with said body, a display card releaseably inserted through the other or open end of said pull tab body into said chamber, and an end cap means for closing said open end of said pull tab body, said upper and lower walls having a substantially equal thickness so that the pull tab provides a uniform display condition at the both sides, said display card, when inserted, fully extending in said chamber and having display surfaces on both sides thereof, said display surfaces each having an area substantially equal to either side surface area of said pull tab body.

2. A slider pull tab according to claim 1, said end cap means being in the form of a plate-like piece provided with a ridge engageable with a complimentary groove in said pull tab body.

3. A slider pull tab according to claim 1, said end cap means being in the form of a plate-like piece integral with said display card.

4. A slider pull tab according to claim 1, said end cap means being an elongate strip hinged at one end to said pull tab body.

5. A slider pull tab according to claim 4, said end cap means including a flexible connector strip integrally interconnecting said one end of the end cap means and said pull tab body.

6. A slider pull tab according to claim 1, said pull tab body being marginally encased in and supported by a metal frame.

7. A slider pull tab according to claim 1, said end cap means being in the form of a steel rod adapted to be inserted through a pair of holes disposed in opposite lateral side portions of said pull tab body, said steel rod having opposite ends each bent along one of a pair of grooves in an end surface of the pull tab body.

8. A slider pull tab according to claim 1, said end cap means being in the form of a bar having one stepwisely reduced end and the other end provided with a pair of projections, said bar being adapted to be inserted laterally through the rectangular body for thereby fitting said reduced end in a hole in one of the lateral side walls of the open end portion of the body and for snap-fitting said pair of projections in a pair of complementary recesses in a through-hole in the other of the lateral side walls of the open end portion.

9. A slider pull tab according to claim 8, said bar including a head collar on said other end.

10. A slider pull tab according to claim 1, said pull tab body including bay portions at said open end of the upper and lower walls thereof in registry with said grip.

11. A slider pull tab according to claim 1, said link having an aperture in which the slider body is loosely fit so that said pull tab body is pivotally movable about said link on the slider body.

12. A slider pull tab according to claim 1, said link including a ball chain connection so that said pull tab body is rotatable about said link.

* * * * *